US006520175B1

(12) United States Patent
Jones

(10) Patent No.: US 6,520,175 B1
(45) Date of Patent: Feb. 18, 2003

(54) FLUE SEAL

(76) Inventor: Jennifer L. Jones, 8123 Persimmon St., Irving, TX (US) 75063-6376

( * ) Notice: Subject to any disclaimer, the term of this patent is extended or adjusted under 35 U.S.C. 154(b) by 0 days.

(21) Appl. No.: 09/557,586

(22) Filed: Apr. 22, 2000

(51) Int. Cl.[7] ..... F23J 13/08

(52) U.S. Cl. ..... 126/319; 454/146; 454/149; 454/904

(58) Field of Search ..... 126/314, 319; 454/284, 289, 904, 146, 149; 49/478.1; 138/89; 55/DIG. 6; 40/621, 600; 294/65.5, 99.1, 902; 248/206.5, 323, 390.4, 317

(56) References Cited

U.S. PATENT DOCUMENTS 429,718 A * 6/1890 Chase
507,657 A * 10/1893 Keach et al.
594,871 A * 12/1897 Hadley
656,352 A * 8/1900 Holmes
874,672 A * 12/1907 Gowin
1,179,287 A * 4/1916 Crowley
1,212,870 A * 1/1917 Zolper ..... 209/215
2,816,790 A * 12/1957 Johnson ..... 204/297.02
3,708,897 A * 1/1973 Adams et al. ..... 116/204
3,845,983 A * 11/1974 Heintz
3,894,527 A 7/1975 Ickes
4,194,494 A 3/1980 Wagner
4,649,896 A 3/1987 Formosa
4,686,893 A * 8/1987 Jinkins
4,762,115 A 8/1988 Penner
4,964,438 A 10/1990 Welty
5,479,984 A * 1/1996 Easterbrook et al.
6,168,516 B1 * 1/2001 White

* cited by examiner

*Primary Examiner*—Carl D. Price
(74) *Attorney, Agent, or Firm*—Daniel V. Thompson

(57) ABSTRACT

A flue seal (10) utilized in conjunction with a flue (12) within a fireplace (14). The flue seal (10) has a magnetic sheet (18) positionable within the flue (12). The magnetic sheet (18) has a sheet opening (18*a*) therethrough. A fastener (20) is securely connected through the sheet opening (18*a*). A pull chain (22) is securely connected to the fastener (20) extending downwardly therefrom.

3 Claims, 4 Drawing Sheets

FLUE SEAL

TECHNICAL FIELD

The present invention relates to a flue seal. More particularly, the present invention relates to a magnetic flue seal functioning to seal the opening of a chimney to prevent heat and energy loss.

BACKGROUND ART

Numerous innovations for flue seals have been provided in the prior art that are described as follows. Even though these innovations may be suitable for the specific individual purposes to which they address, they differ from the present invention as hereinafter contrasted.

U.S. Pat. No. 4,964,438, titled "Air Duct Plug", by Welty, discloses a foam air duct plug provided for insertion up into an open end of an air duct during periods of nonuse to prevent or limit the escape of cooled or heated air through said air duct, in a dwelling, public building or structure thereof. The plug further provides a depending handle for ease of removal from the air duct when it is determined that said air duct should be used.

U.S. Pat. No. 4,762,115, titled "Draft Plugging Device for a Chimney Flue", by Penner, discloses a device for plugging a chimney flue when not in use. The device comprises an elongate semi-rigid wand which can be maneuvered by manual movement of one end so that the opposed end can be inserted into the chimney flue. The opposed end carries an inflatable balloon which can be inflated to grasp the inner surface of the flue by valve arrangement at the lower end.

U.S. Pat. No. 4,194,494, titled "Fireplace Plug", by Wagner, discloses a fireplace plug for closing the metallic throat of a fireplace during periods of nonuse. The plug has a body, for obstructing the throat, which carries a magnetic means for securing the body to the throat. The plug further provides a handle for ease in inserting the plug into the throat and requires an indicating means for indicating that the plug has been inserted into the throat of the fireplace.

U.S. Pat. No. 3,894,527, titled "Cover for Circulating Fireplace Registers", by Ickes, discloses a cover for the outside of a small register on a circulating fireplace so to prevent thermal losses when a home is heated in winter or air conditioned during summer. The device consists of a plate which can be variously supported over a small register so as to make an air tight seal such as by use of magnets for attachment and the use of a gasket around its edge to prevent air leakage.

U.S. Pat. No. 874,672, titled "Flue Stop, by Gowin", comprises a magnetic flue stop.

The above patented inventions differ from the present invention because they fail to describe or claim at least one combination of the following features depicted in the present invention: magnetic sheet with sheet opening; fastener comprising a fastener eye bolt, optional fastener nut, fastener cap nut, two metal fastener small washers, and two elastomeric fastener larger washers; and pull chain.

Numerous innovations for flue seals have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a flue seal. More particularly, the present invention relates to a magnetic flue seal functioning to seal the opening of a chimney to prevent heat and energy loss.

The types of problems encountered in the prior art relate to ease of use. Prior art chimney caps require the user to climb on the roof for installation. Prior art foam flue inserts require the user to conform the shape into a complimentary configuration as the flue.

Innovations within the prior art are rapidly being exploited in the field of energy conservation.

The present invention went contrary to the teaching of the art which describes and claims flue caps and foam inserts.

The present invention solved a long felt need for a simple and easy to use retrofittable flue seal.

Accordingly, it is an object of the present invention to provide a flue seal having a magnetic sheet with a sheet opening, a fastener, and a pull chain.

More particularly, it is an object of the present invention to provide a fastener having a fastener eye bolt, optional fastener nut, fastener cap nut, two metal fastener small washers, and two elastomeric fastener larger washers.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

List of Reference Numerals Utilized in The Drawings

10—flue seal (10)
12—flue (12)
14—fireplace (14)
16—damper (16)
16*a*—damper plate (16*a*)
16*b*—damper shaft (16*b*)
18—magnetic sheet (18)
18*a*—sheet opening (18*a*)
20—fastener (20)
20*a*—fastener eye bolt (20*a*)
20*b*—fastener nut (20*b*)
20*c*—fastener cap nut (20*c*)
20*d*—fastener small washer (20*d*)
20*e*—fastener larger washer (20*e*)
22—pull chain (22)

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
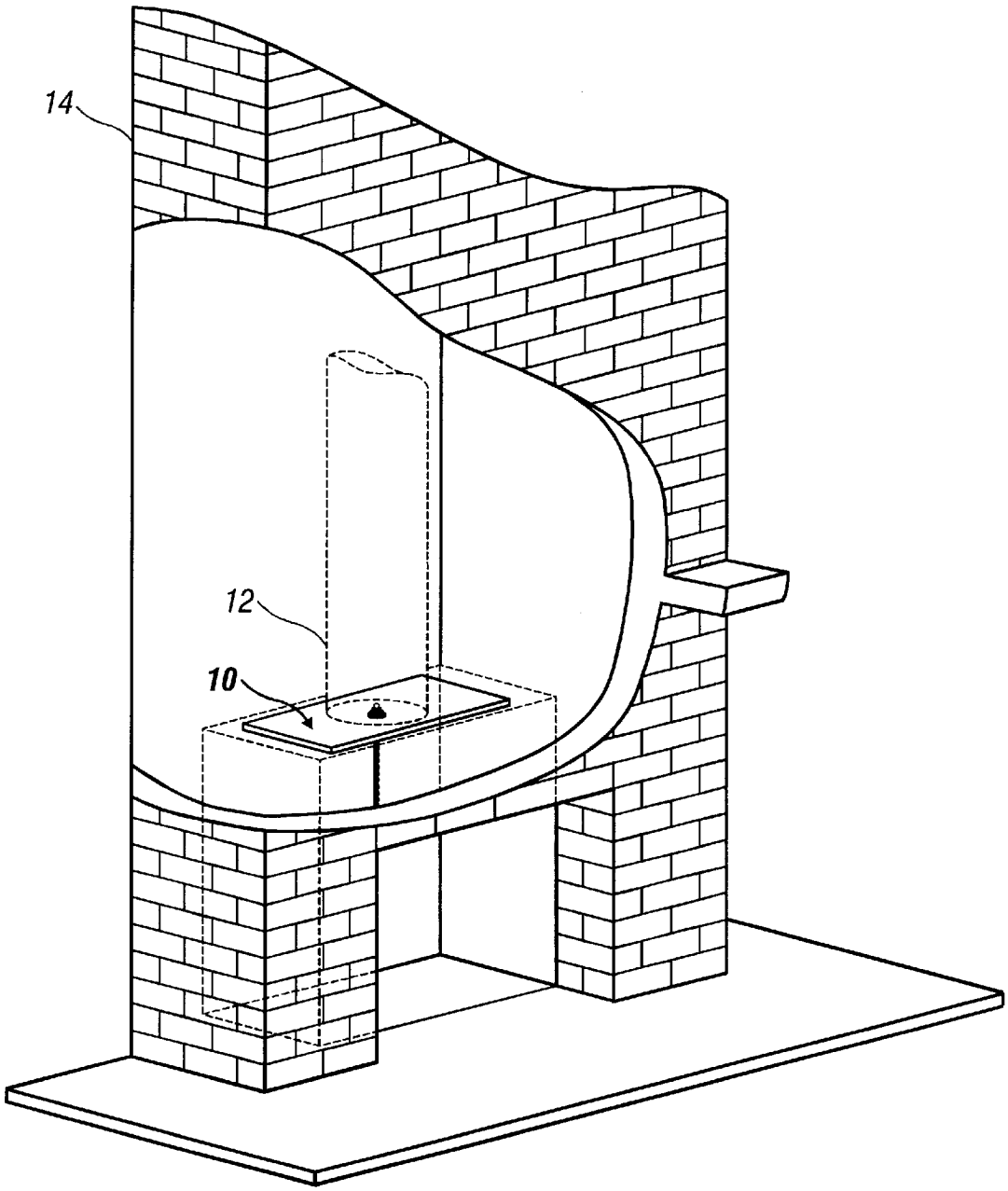
FIG. 1 is a left-top perspective cut away view of a flue seal (10) contained within a fireplace (14).
Figure 2A:
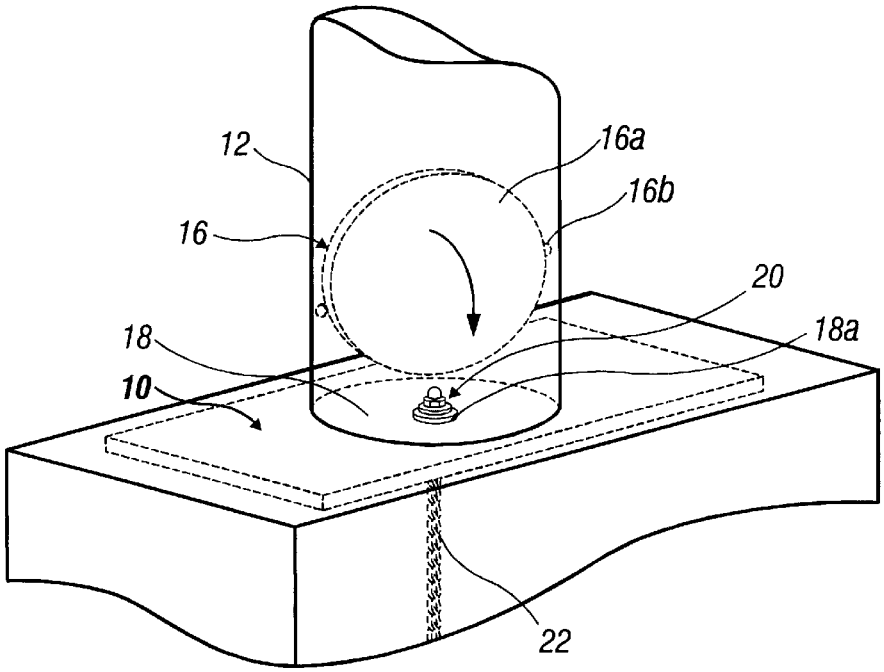
FIG. 2A is a left-top perspective view of a flue seal (10) positioned at a lower distal end of a flue (12) exhibiting the damper (16) in an open position.
Figure 2B:
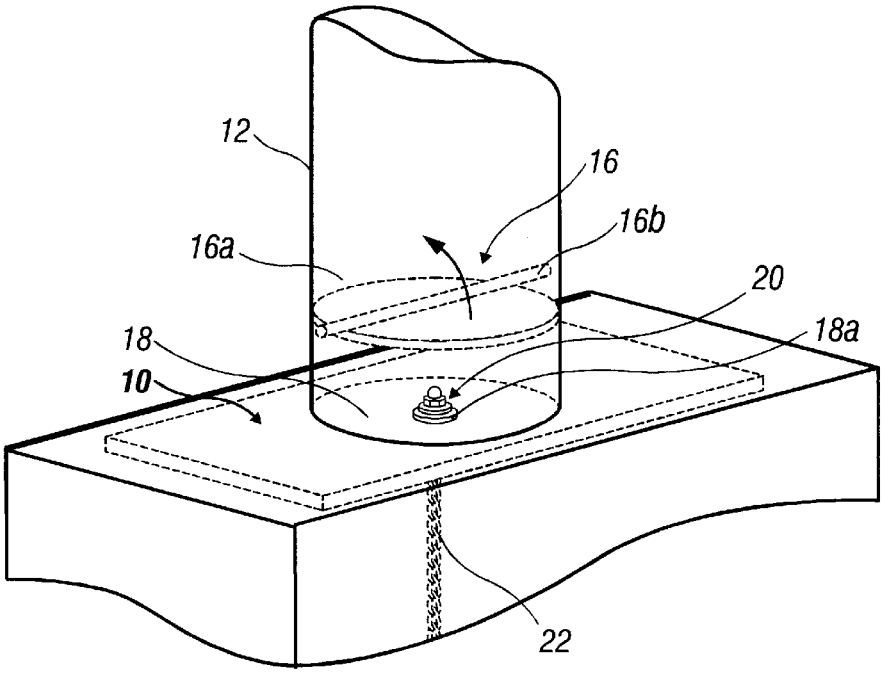
FIG. 2B is a left-top perspective view of a flue seal (10) positioned at a lower distal end of a flue (12) exhibiting the damper (16) in a closed position.

First we refer to FIG. 1, which is a left-top perspective cut away view of a flue seal (10) contained within a fireplace (14), as well as FIG. 2A and FIG. 2B, which are a left-top perspective view of a flue seal (10) positioned at a lower distal end of a flue (12) exhibiting the damper (16) in an open and closed position, respectively. The flue seal (10) is utilized in conjunction with an iron-containing (i.e., iron or steel) metallic flue (12) within a fireplace (14). The flue (12) further comprises a damper (16) having a damper plate (16*a*) securely attached to a pivoting damper shaft (16*b*). The flue seal (10) comprises a magnetic sheet (18) positionable adjacent to and underneath the flue (12). The magnetic sheet (18) comprises a sheet opening (18*a*) therethrough. (refer to FIG. 3A).

Referring now to FIGS. 4A, 4B, 4C, and 4D, the flue seal (10) further comprises a fastener (20) securely connected through the magnetic sheet opening (18*a*). The fastener (20) comprises a fastener eye bolt (20*a*) positioned through the sheet opening (18*a*). The fastener eye bolt (20*a*) is positioned with the eye down and the threads up. A fastener cap nut (20*c*) is positioned at a top distal end of fastener eye bolt (20*a*). A first fastener small washer (20*d*) is positioned between a first fastener larger washer (20*e*) and the fastener cap nut (20*c*), with the first fastener larger washer (20*e*) abutting a top surface of the magnetic sheet (18). The fastener (20) further comprises a second fastener small washer (20*d*) positioned between a second fastener larger washer (20*e*) and a proximally positioned fastener nut (20*b*), the second fastener larger washer (20*e*) abutting a bottom surface of the magnetic sheet (18). Preferably the small fastener washers (20*d*) are metal, and the larger fastener washers (20*e*) are elastomeric. The fastener nut (20*b*) is optional if the length of the threads of fastener eye bolt (20*a*) is such that the fastener cap nut (20*c*) securely clamps the assembly without the fastener nut (20*b*).

Figure 3A:
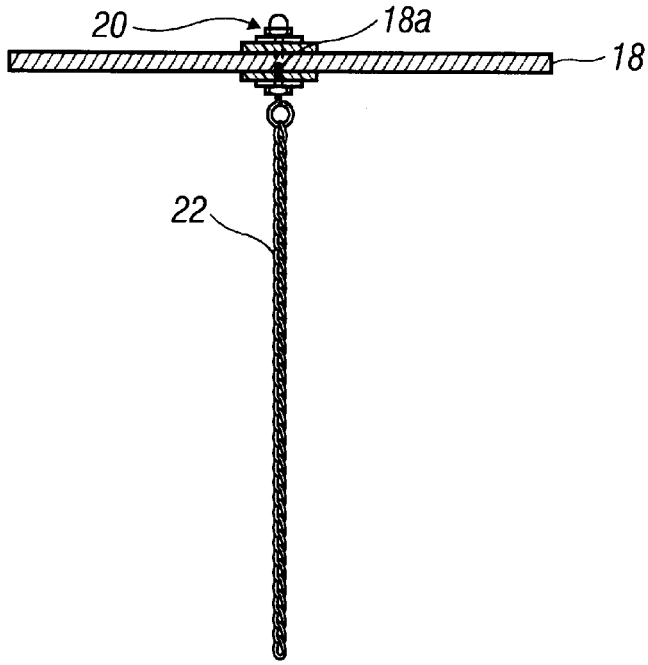
FIG. 3A is a partially broken away side view of a magnetic sheet (18) with a pull chain (22) attached to a fastener (20).
Figure 3B:
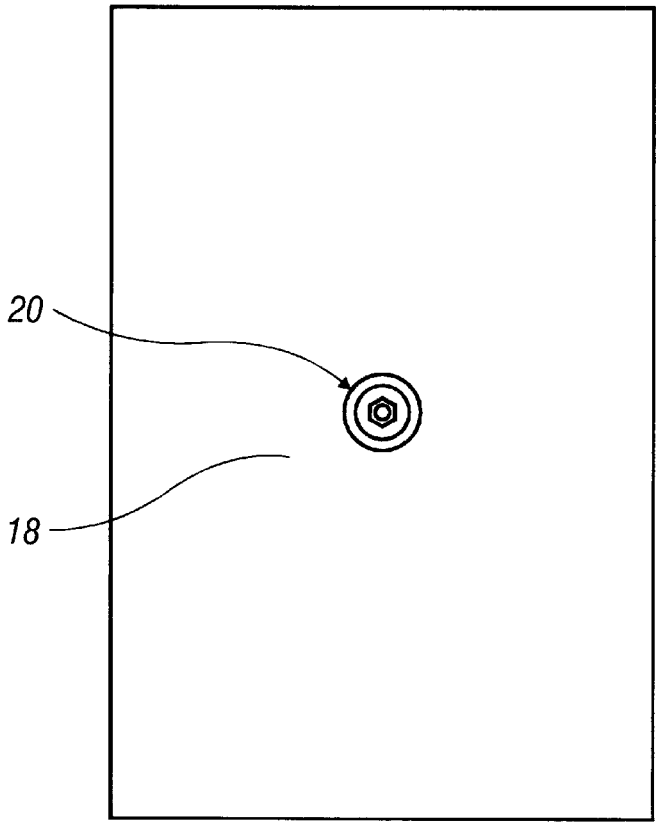
FIG. 3B is a top view of a flue seal (10).
Figure 4A:
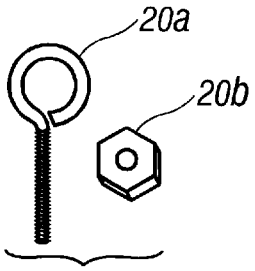
FIG. 4A is a side view of a fastener eye bolt (20*a*) and corresponding fastener nut (20*b*).
Figure 4B:
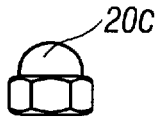
FIG. 4B is a side view of a fastener cap nut (20*c*).
Figure 4C:
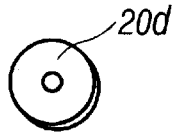
FIG. 4C is a side view of a fastener small washer (20*d*).
Figure 4D:
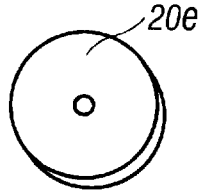
FIG. 4D is a side view of a fastener larger washer (20*e*).
Figure 4E:
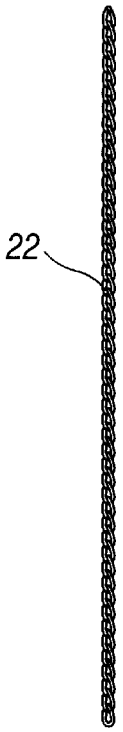
FIG. 4E is a side view of a pull chain (22).

Referring to FIG. 3A and FIG. 4E, flue seal (10) further comprises a pull chain (22) securely connected to the fastener (20) extending downwardly therefrom.

Figure 4F:
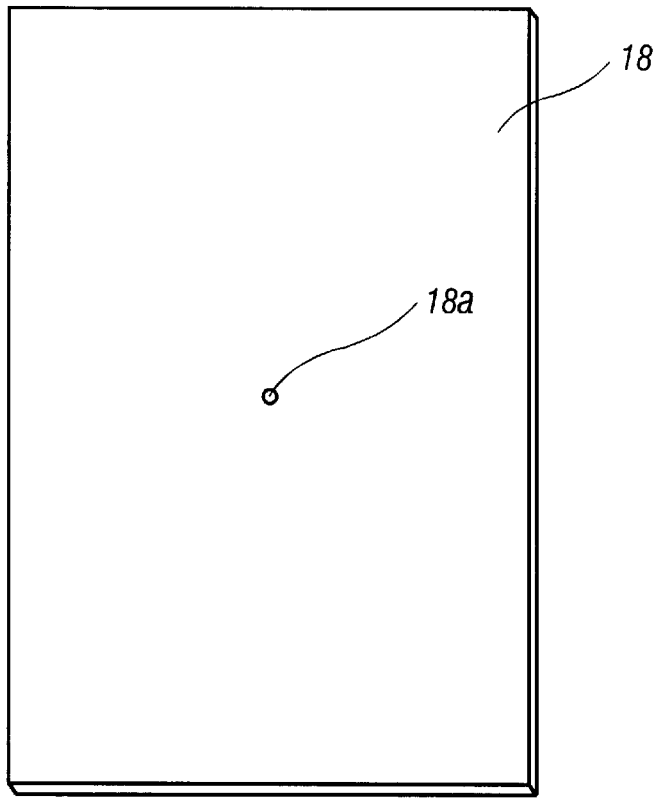
FIG. 4F is a top view of a magnetic sheet (18) prior to assembly into a flue seal (10).

Referring to FIG. 4F, the flue seal (10) further is formed from a magnetic sheet (18) of magnetic plastic material, such material commonly used to make magnetic vehicle signs. One example of the invention was made from a sheet of magnetic plastic material 0.030 inch thick, 18 inches long and 12 inches wide. The material is easily manufactured from a standard size in this range, then trimmed by the user to exactly fit the user's flue for optimum sealing. Another alternative is to lightly score the material in a grid pattern, enabling the user to snap off the perimeter of excess material to perfectly fit the user's flue.

In operation, it is well known that chimney flues are subject to substantial air leakage, permitting a large volume of heated or cooled interior air to be lost to the exterior of the building. This is a major source of energy loss in homes and buildings with fireplaces. The typical flue includes a damper 16 of the type illustrated in FIGS. 2A and 2B, but due to operational requirements and manufacturing tolerances such dampers do not adequately seal and are relatively dirty and awkward to operate.

The solution is the magnetic flue seal of the present invention. Due to the large surface area and strong magnetic attraction of the material in magnetic sheet (18), a tight air proof seal is obtained, yet the device is easy to place and remove with the convenient pull chain.

It will be understood that each of the elements described above, or two or more together, may also find a useful application in other types of constructions differing from the type described above.

While the invention has been illustrated and described as embodied in a flue seal, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

Whereas, the present invention has been described with respect to a specific embodiment thereof, it will be understood that various changes and modifications will be suggested to one skilled in the art and it is intended to encompass such changes and modifications as fall within the scope of the appended claims.

I claim:

1. A flue seal (10) utilized in conjunction with an iron-containing metallic flue (12) within a fireplace (14), the flue seal (10) comprising:

A) a magnetic sheet (18) positionable adjacent to and underneath the flue (12), the magnetic sheet (18) comprising a sheet opening (18*a*) therethrough;

B) a fastener (20) securely connected through the sheet opening (18*a*); and C) a pull chain (22) securely connected to the fastener (20) extending downwardly therefrom; and D) wherein the fastener (20) comprises a fastener cap nut (20*c*) positioned at a top distal end of a fastener eye bolt (20*a*), a first fastener small washer (20*d*) positioned between a first fastener larger washer (20*c*) and the fastener cap nut (20*c*), the first fastener larger washer (20*c*) abutting a top surface of the magnetic sheet (18), a second fastener small washer (20*d*) positioned between a second fastener larger washer (20*e*) and an eye of the fastener eye bolt (20*a*), with the second fastener larger washer abutting a bottom surface of the magnetic sheet (18).

2. The flue seal (10) as described in claim 1, with a proximally positioned fastener nut (20*b*) between the second fastener small washer (20*d*) and the eye of the fastener eye bolt (20*a*).

3. The flue seal (10) as described in claim 1 with the small fastener washers (20*d*) being metal, and the larger fastener washers (20*e*) being elastomeric.

* * * * *